United States Patent [19]

Shuster

[11] Patent Number: 4,480,295

[45] Date of Patent: Oct. 30, 1984

[54] WORK SURFACE LIGHT

[76] Inventor: Frank J. Shuster, Star Rte. 4, Box 251A, Hibbing, Minn. 55746

[21] Appl. No.: 477,639

[22] Filed: Mar. 21, 1983

[51] Int. Cl.[3] ..... F21L 7/00

[52] U.S. Cl. ..... 362/206; 362/109; 362/119; 362/120; 362/184; 362/189; 362/191; 362/205; 362/251; 362/295; 362/311; 362/375; 200/60

[58] Field of Search ..... 362/109, 119, 120, 184, 362/191, 205, 189, 295, 206, 251, 311, 375; 200/60

[56] References Cited

U.S. PATENT DOCUMENTS 3,919,541 11/1975 Chao ..... 362/120

*Primary Examiner*—Stephen J. Lechert, Jr.
*Attorney, Agent, or Firm*—James E. Olds

[57] ABSTRACT

A work surface light apparatus includes a plastic housing (12) having a central longitudinal opening (34). At one end of the opening (34) is an end plate (30); at the other end, longitudinally aligned, is a cap (14). A soft flexible and expandable grommet (36) is secured in each opening (34). Within the housing (12) surrounding the central longitudinal opening (34) is a battery (22), a lamp (24), wires (32) for interconnecting the lamp (24) with the battery (22), an electrical switch (18) electrically interconnected with the wires (32) to control the lamp (24), and third plate (26) that secures the lamp (24) in place.

1 Claim, 5 Drawing Figures

WORK SURFACE LIGHT

TECHNICAL FIELD

This invention relates to an apparatus that can be readily attached to a hand tool, such as a screwdriver, to selectively illuminate a work area.

BACKGROUND OF THE INVENTION AND PRIOR ART

The present invention relates to an illuminator apparatus that can be attached to the shaft of a screwdriver, drill bit, drive bar extension, and similar tools having elongated shafts, by sliding the elongated shaft of the tool through longitudinal aperatures aligned with the longitudinal axis of the illuminator apparatus. Light from the apparatus then illuminates a specific surface, and oftentimes a relatively small work area, to enable a workperson to better see the particular task he is attempting to perform. Thus, the illuminator attachment on the shaft of a screwdriver, the shaft of a drill bit, or the shaft of the drive bar extension, illuminates the screw to be turned, the work piece to be drilled, or the bolt head to be turned, all commonly in a relatively darkened work area. The darkened area may be a hazardous area such as within an electrically live control, junction or receptacle box where safety may be of paramount importance, especially if only one workperson is trying to work near the electrically live connectors and hold a flashlight at the same time! Additionally, but primarily for the convenience of the worker, the illuminator attachment provides shadow-free light on a surface to be drilled enabling more precise location of the drill bit to the work surface. Similarly, the illuminator attachment on a drive bar extension can simplify the tightening (or loosening) of a bolt in a relatively darkened work area.

Screwdrivers that have a light within the handle portion of the screwdriver are known in the prior art such as shown in U.S. Pat. No. 1,217,657, which appears to be a conventional flashlight with a screwdriver attached to the lens of the flashlight to illuminate the screw to be turned by the screwdriver. Also, it is known that Sears, Roebuck and Company has a screwdriver offered for sale, identified by the trademark "TOOL-LITE", that utilizes lights within the handle of the screwdriver to illuminate the workplace.

Prior to the present invention, there existed no attachments that could be simply attached to the shaft of the screwdriver, drill bit, or drive bar extension, that would adapt a presently existing screwdriver, drill bit or drive bar extension to an illuminating hand tool to effectively illuminate the work surface. Nor has any prior attachment been interchangeable between various diameter drill bits, screwdrivers, or drive bar extensions.

In most applications, illumination when working with a screwdriver, drill bit or drive bar extension is not needed and the presently existing screwdrivers, drills and socket sets are the most practical and efficient tools to be used. But there are times, such as when using a screwdriver to make electrical connections within an electrically live control junction, that additional light on a specific surface provides the extra safety, accuracy, and convenience so desired by the workperson. In such situations, the apparatus of the present invention can be readily added to a common screwdriver and provide additional safety by illuminating the workplace so that potentially dangerous electrical shocks can be avoided. After the need for additional illiminator is completed, this apparatus can be readily removed from the screwdriver and thus the screwdriver is readily returned to its normal balanced, durable, and effective design for normal uses. Thus, the present invention provides for more safety in working in an electrically live control box; especially if only one person is available to do the work, and both hands are required to perform such work, one can not, therefore, effectively hold a flashlight in one hand and perform such work safely around the electrically live wires. Although the attachment can be readily switched from the screwdriver to drill bits of different diameters, the attachment is not rigidly secured to the drill bit, therefore, if a portion of someone's clothing came into contact with the turning attachment on a drill bit, the drill bit would be free to continue rotating within the stopped attachment and thus the attachment would not cause the clothing to be wrapped about the drill bit. A still further advantage of the present invention is that since the attachment can be readily added to or taken off of the screwdriver, drill bit, or drive bar extension, the effective design of the tool, as it is normally used, is not altered for its normal uses.

SUMMARY OF THE INVENTION

The present invention is an apparatus adapted to be attached to a screwdriver, drill bit, or drive bar extension that will selectively illuminate a work surface. The apparatus includes a housing having central longitudinal openings in each end of the apparatus, concentric with the longitudinal axis of the apparatus, through which is inserted the shaft of the screwdriver, the shaft of the drill bit, or the shaft of the drive bar extension. The housing then surrounding this shaft includes a battery that provides the electrical energy source, a light, wires for interconnecting the light with the battery, and an electrical switch electrically interconnected with the wires to turn the light on and off as desired. A flexible and expandable grommet is located within longitudinally aligned openings in the cap and end plate to provide adaptability and interchangeability of the apparatus to a range of tool shaft diameters and shapes. The grommets may be of different internal opening sizes to provide greater adaptability of the apparatus to an even greater range of tool shaft diameters.

DETAILED DESCRIPTION OF THE PREFERRED EMBODIMENT

Figure 1:
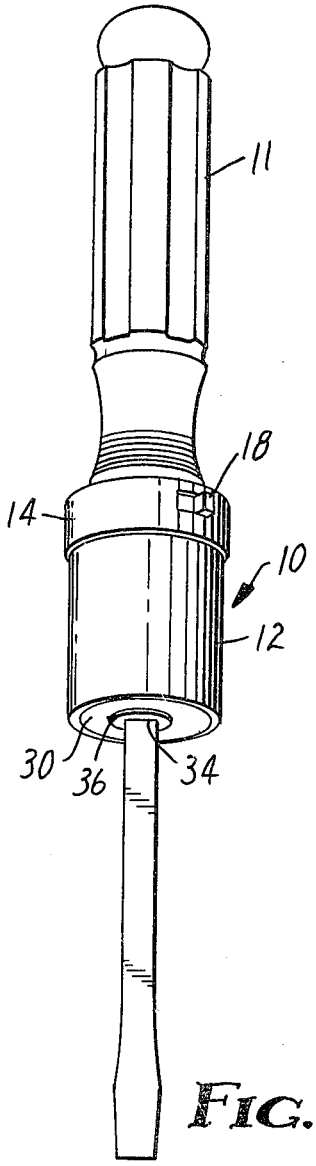
FIG. 1 is a perspective view showing the present invention in combination with a standard screwdriver.
Figure 2:
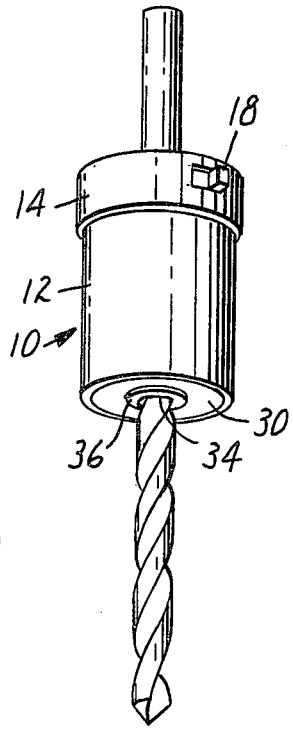
FIG. 2 is a perspective view showing the present invention in combination with a drill bit.
Figure 3:
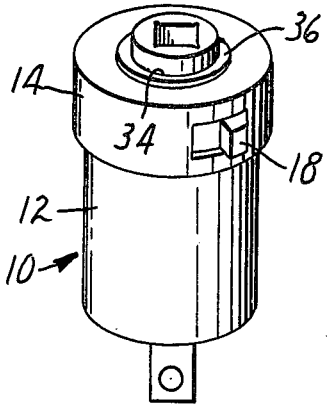
FIG. 3 is a perspective view showing the present invention in combination with a drive bar extension.
Figure 4:
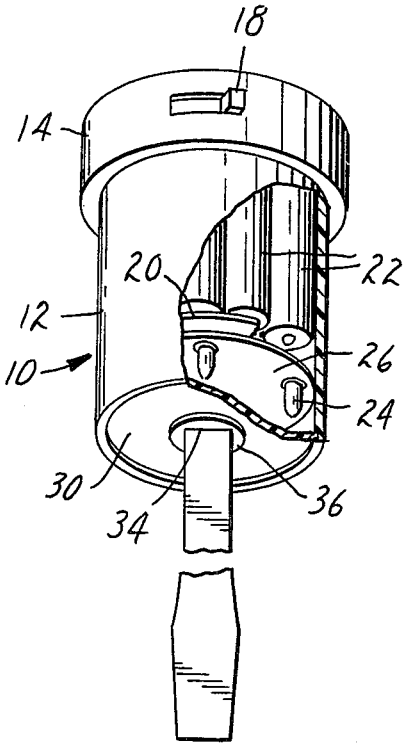
FIG. 4 is a perspective view showing the present invention in combination with a shaft of a screwdriver (handle thereof not shown) wherein the housing of the illuminating apparatus is cut away to show the internal portions thereof.

Referring now to the drawings in detail, there is shown in FIG. 1, one embodiment of the present invention, wherein the Work Surface Light Apparatus 10 is retained on the shaft of a common screwdriver. FIGS. 2 and 3 show the apparatus 10 retained alternatively on a drill bit and a drive bar extension. The plastic housing 12 (see FIG. 4) is electrically non-conductive and cylindrically shaped with plastic cap 14 threadly attached to the outside of the housing 12 to facilitate removal of the cap 14 from the housing for battery replacement.

Figure 5:
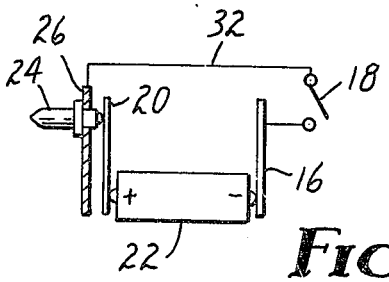
FIG. 5 is a mechanical-electrical drawing showing the electrical circuitry of the invention.

The electrically insulating cap 14 includes an inside first electrically conductive surface 16 (see FIG. 5) and a electrical switch 18. A second electrically conductive surface 20 (see FIG. 5) electrically interconnects between the batteries 22 and the lamps 24. A third plate 26, electrically conductive, has a threaded hole to secure each lamp 24 in place and to complete the electrical circuit from the surface 20, through the lamp 24 and to the wire 32 that completes the circuit back to the switch 18. A translucent end plate 30 (see FIG. 4) defuses the light coming from the lamps 24 to provide a relatively shadow free illumination of the work surface.

Although a single lamp may be used, it is more desirable to use two or more lamps to provide more uniform and shadow free illumination of the work surface. The switch 18 is shown as a common on-off, push-pull, electrical switch interconnected between the first electrical surface 16 and the third plate 26 by wires 32. Other electrical switches could be used, such as a rotating cap and switch between the cap and housing 12 to eliminate all projections from the housing 12.

As should be apparent, the blade of a screwdriver, drill bit or drive bar extension is pushed through the axially aligned longitudinal openings in the grommets 36 to attach the work surface light to the hand tool. The present embodiment shows the batteries in an electrical parallel circuit but they could be arranged in a series circuit if desired. A flexible and expandable grommet 36, having a center opening 34, is located within the longitudinally aligned openings in the cap 14 and end plate 30.

After reading the foregoing detailed description, it should be apparent that the advantages provided by the present invention, as set forth at the outset of the specification, have been successfully achieved by the present invention.

I claim:

1. An illuminator attachment adapted to be selectively added to various tools such as screwdrivers, drill bits and socket extension bars, all of which could have different cross-section diameters of elogated shafts that slide through the attachment, to provide illumination of a workplace, comprising:

(a) a housing having a generally centrally located longitudinal aperature through said housing for receiving the shaft of the tool, said housing is generally cylindrically shaped about a longitudinal axis and includes two end plates, one at each end of said housing, each of said end plates including plate aperatures concentric with said longitudinal axis of the housing;

(b) battery means within said housing for providing energy to the apparatus;

(c) light means for providing illumination of the workplace;

(d) switch means electrically interconnected with said light means and said battery means for selectively illuminating said light means; and (e) two resilient flexible grommets, each having a center opening, one of each grommets inserted into each of said aperatures, wherein the resiliency of said grommets adapts to various cross-sectional diameters of the elongated shafts of the various tools inserted through said center openings in said grommets to allow the illuminator attachment to receive shafts of varying diameters so that said illuminator attachment may be selectively added to various tools.

* * * * *